US006293412B1

(12) United States Patent
Draper

(10) Patent No.: US 6,293,412 B1
(45) Date of Patent: Sep. 25, 2001

(54) SKATEBOARD RACK

(76) Inventor: Sandra Draper, 501 Alta La., El Cajon, CA (US) 92021

( * ) Notice: Subject to any disclaimer, the term of this patent is extended or adjusted under 35 U.S.C. 154(b) by 0 days.

(21) Appl. No.: 09/602,146

(22) Filed: Jun. 21, 2000

(51) Int. Cl.[7] ..... A47F 5/00

(52) U.S. Cl. ..... 211/4; 211/85.7; 211/87.01; D6/552; 248/552; 70/58

(58) Field of Search ..... 211/85.7, 4, 8, 211/60.1, 87.01; D6/552; 70/58; 248/551, 552

(56) References Cited

U.S. PATENT DOCUMENTS

D. 342,637 * 12/1993 Smith ..... D6/552
D. 354,872 * 1/1995 Dix ..... D6/552
D. 396,371 * 7/1998 Oliver ..... D6/552
D. 425,745 * 5/2000 Harris et al. ..... D6/552
4,773,239 * 9/1988 Lowe et al. ..... 70/58 X
5,040,385 * 8/1991 Randone ..... 211/4 X
5,179,847 * 1/1993 Dorn ..... 70/58 X
5,301,818 * 4/1994 Dix ..... 211/87.01 X
5,305,897 * 4/1994 Smith ..... 211/87.01 X
5,582,044 * 12/1996 Bolich ..... 70/58
5,706,680 * 1/1998 Wrobb ..... 70/58 X
5,901,588 * 5/1999 Frost ..... 70/58 X

* cited by examiner

*Primary Examiner*—Robert W. Gibson, Jr.
(74) *Attorney, Agent, or Firm*—Steins & Associates

(57) ABSTRACT

An Improved Skateboard Rack is disclosed. Also disclosed is a rack that provides users with a safe, secure and easily-used location to securely lock their skateboards. The preferred rack is attachable to a base frame in order to provide a location to secure several skateboards at one time. In the preferred embodiments, the rack provides means for hanging a conventional skateboard from its trucks in a manner that is simple enough for an adolescent to use.

18 Claims, 7 Drawing Sheets

SKATEBOARD RACK

BACKGROUND OF THE INVENTION

1. Field of the Invention

This invention relates generally to racks for sporting goods and, more specifically, to an Improved Skateboard Rack.

2. Description of Related Art

Skateboards, as shown in FIG. 1, have become a prevalent mode of transportation for today's youth. It is rare to find a child that has not ridden a skateboard 10, and most use skateboards daily. FIG. 1 is a perspective view of a conventional skateboard 10. In its typical form, it comprises a deck 12 usually made from wood, and a pair of wheel assemblies 14 located at the front and back of the deck 12. Each wheel assembly 14 typically will comprise a set of trucks 16, which are attached to the deck 12, and a pair of wheels 18 extending from each end of the trucks 16.

The problem with the popularity of the skateboard 10 is that they have become coveted by thieves. Since there has been no reliable means for the public to secure their skateboards in a certain location, many individuals find themselves carrying their skateboards with them wherever they go. This presents a particular problem for the school system since the classrooms are typically not an appropriate place for a skateboard to be stored. What is needed is a skateboard rack that is easy enough for a child to use, but still provides substantial security by locking the skateboard in place until the child needs it.

SUMMARY OF THE INVENTION

In light of the aforementioned problems associated with the prior devices, it is an object of the present invention to provide an Improved Skateboard Rack. It is also an object that the preferred rack will provide users with a safe, secure and easily-used location to securely lock their skateboards. It is another object that the rack be attachable to a base frame in order to provide a location to secure several skateboards at one time. It is yet another object that the rack provide means for hanging a conventional skateboard from its trucks. Finally, it is an object that the rack be simple enough for an adolescent to use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide an Improved Skateboard Rack.

Figure 1:
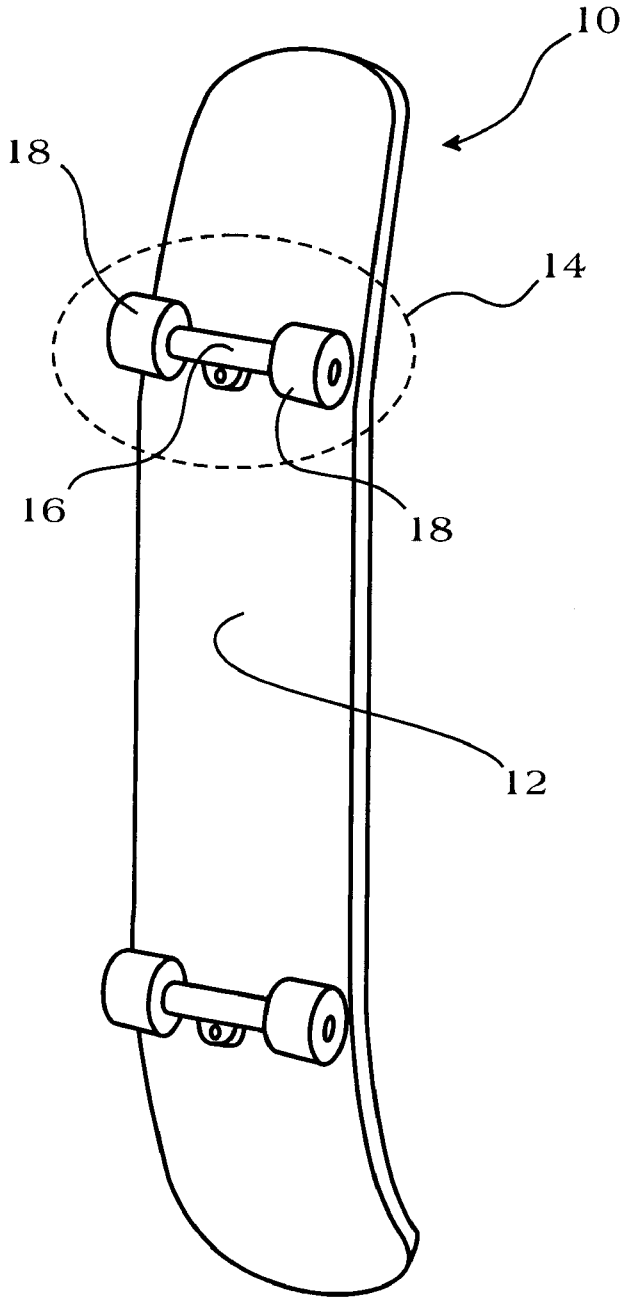
Figure 1 PRIOR ART
FIG. 1 is a perspective view of a conventional skateboard.
Figure 2:
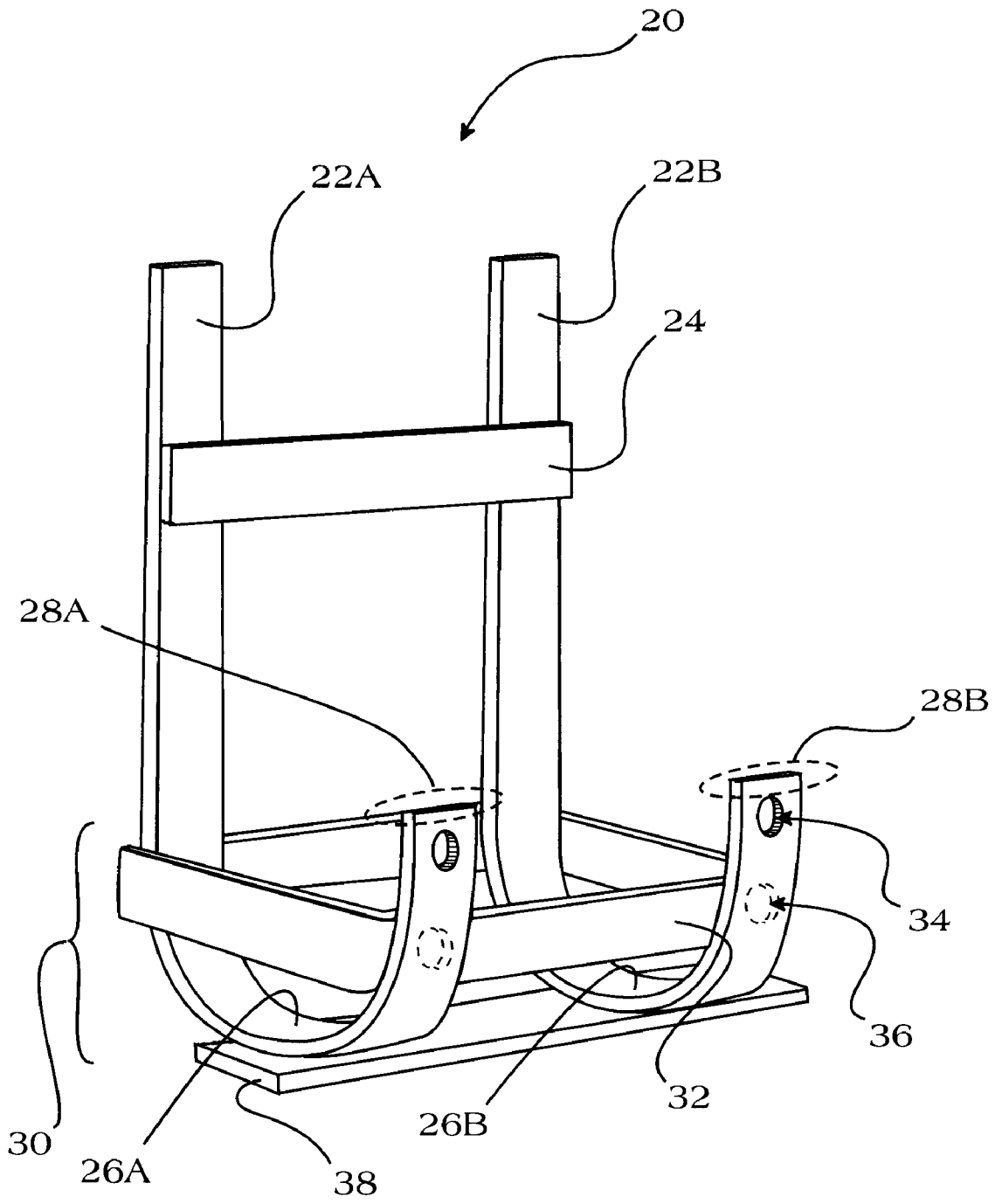
FIG. 2 is a perspective view of the improved skateboard rack of the present invention.

The present invention can best be understood by initial consideration of FIG. 2. FIG. 2 is a perspective view of the improved skateboard rack 20 of the present invention. In its preferred form, the skateboard rack 20 comprises a pair of struts 22A and 22B in spaced relation to one another and connected to one another by a cross bar 24. As can be seen, the struts 22A and 22B are not straight, but in fact include an elbow 26A and 26B and finally terminate in an upwardly turned bottom end 28A and 28B. Arranged in the lower portion of the struts 22A and 22B is wheel lock means 30. In this embodiment, the wheel lock means 30 comprises a locking ring 32, which is loosely hanging from the elbows 26A and 26B. Adjacent to the bottom end 28A and 28B are a pair of apertures 34 which are configured to cooperate with the locking ring apertures 36 shown in hidden lines in this drawing. Attached on the outer or bottom surface of the elbows 26A and 26B is a retaining plate 38 to prevent the locking ring 32 from being removed from the struts 22A and 22B. The operation of the wheel lock means 30 will be described below in connection with FIG. 4. If we turn to FIG. 3, however, we can see how a skateboard might be hung from the preferred rack 20.

Figure 3:
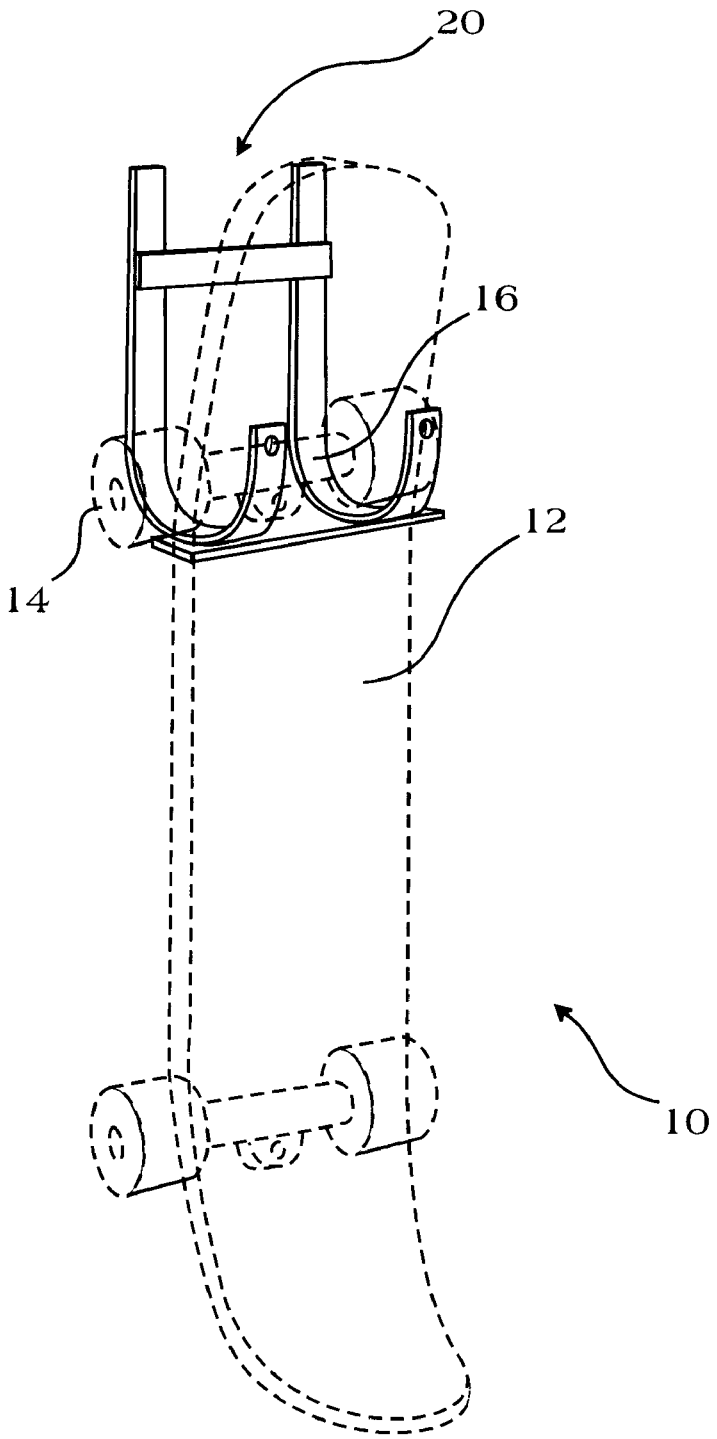
FIG. 3 is a perspective view of a skateboard hanging from the skateboard rack of the present invention.

FIG. 3 is a perspective view of a skateboard 10 hanging from the skateboard rack 20 of the present invention. As you can see in FIG. 3, the skateboard 10 hangs from the preferred rack 20 by its wheel assembly 14. When hanging as shown, the bottom ends 28 will reside between the wheel assembly 14 and the skateboard deck 12. The bend radius of elbows 26 and the distance between the struts 22 are dimensioned to appropriately hang and lock virtually any size conventional skateboard by its trucks. There preferably is a loose fit to the struts in order to provide for a wide variety of shapes and styles of skateboards 10. Now turning to FIG. 4, we can see how the skateboard is locked to the rack 20.

Figure 4:
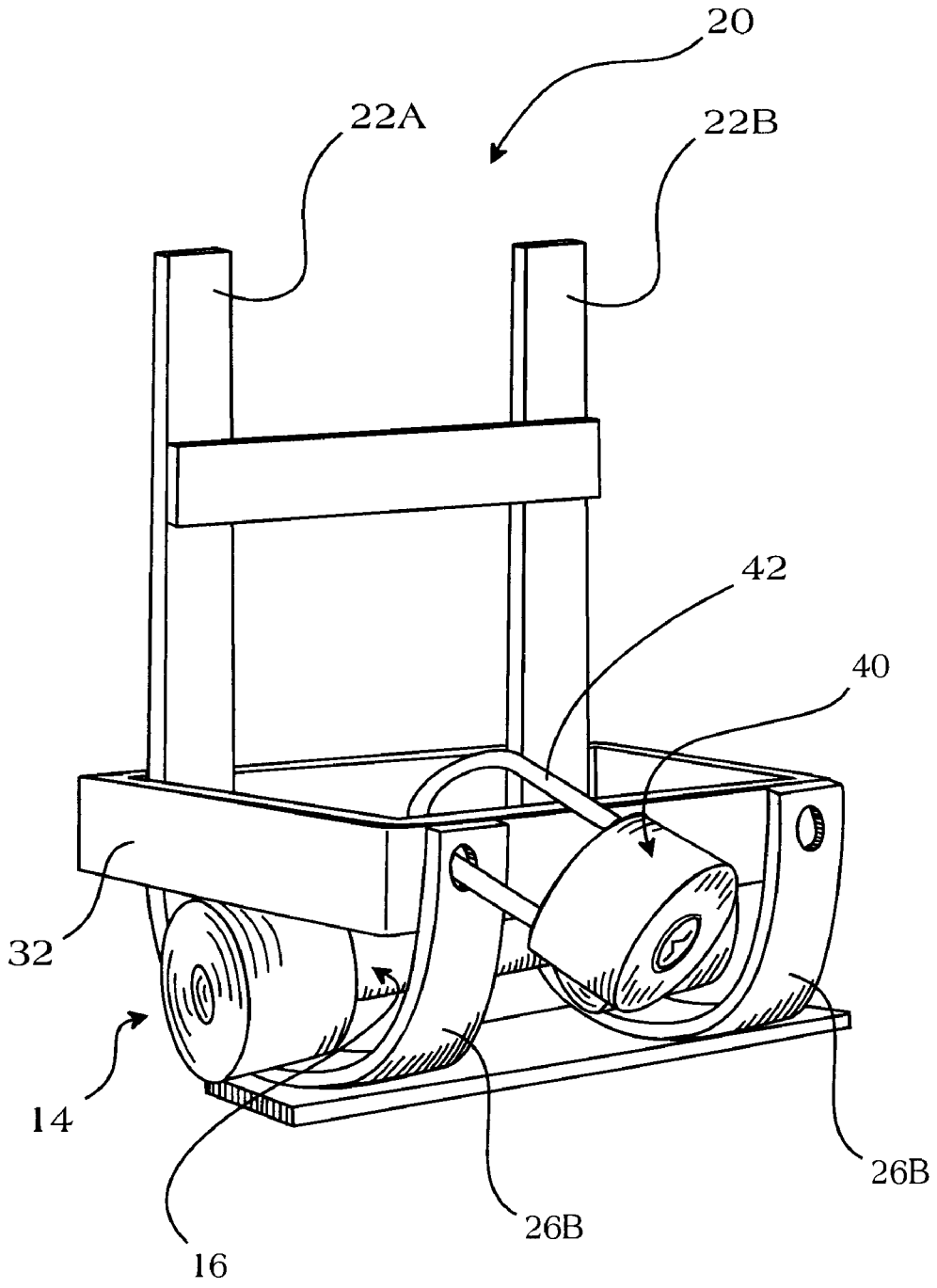
FIG. 4 is a perspective view depicting the skateboard rack of FIGS. 2 and 3 with the trucks locked.

FIG. 4 is a perspective view depicting the skateboard rack 20 of FIGS. 2 and 3 with the trucks 16 locked. In this diagram (which excludes the skateboard deck 12), we can see that the trucks 16 and wheel assembly 14 are resting on the elbows 26A and 26B. It should be understood that prior to inserting or dropping the skateboard onto the elbows 26A and 26B, the user must raise the locking ring 32 so that the wheel assembly 14 can be placed therein. Once in place, the apertures 34 and 36 (see FIG. 2) are aligned and the user inserts the lock bolt 42 of any conventional locking device 40 (such as the padlock shown here) through the aligned apertures 34 and 36. As can be seen now, the wheel assembly 14 is locked securely to the rack 20. If we now turn to FIG. 5, we can see how a preferred rack assembly might be configured.

Figure 5:
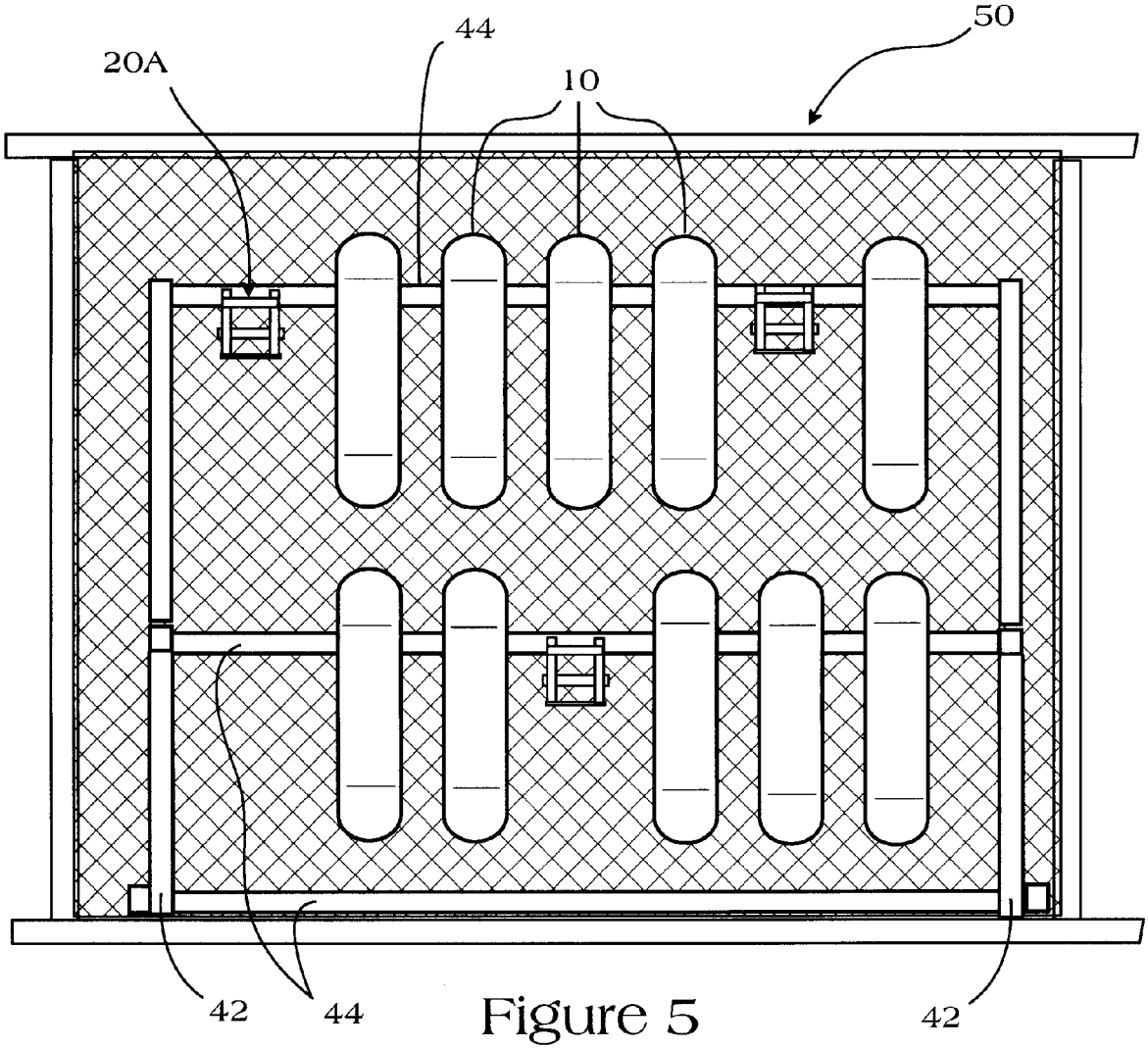
FIG. 5 is a front view of an improved skateboard rack assembly.

FIG. 5 is a front view of an improved skateboard rack assembly 50. As we can see in this embodiment, the rack 50 comprises a pair of vertical posts 42 connected to one another by three horizontal bars 44. Dispersed across the top two horizontal bars 44 are the skateboard racks described above in connection with FIGS. 2 through 4. In this manner, a plurality of skateboards 10 can be hung from the rack assembly 50 in an extremely compact space. It should further be noticed that in some cases a single skateboard rack 28 might be provided at the top most horizontal bar 44 while leading the rack off of the center horizontal bar 44. This would provide a locking location for an extra long skateboard such as the type known as "long boards" (used for "cruising"). As is apparent, the rack assembly 50 can be made in a variety of sizes and configurations in order to accommodate the particular site in which it is installed. It should further be appreciated that while the racks 20 are shown attached to a rack assembly 50 here, the racks 20 might simply be attached to a pre-existing wall or some other structure if desired.

Another preferred option might be to provide a small roof over the top of the top horizontal bar 44 that extends outwardly to protect the skateboards 10 from inclement weather. Any conventional structure to provide this roof would be sufficient. If we now turn to FIG. 6, we can examine yet another preferred embodiment.

Figure 6:
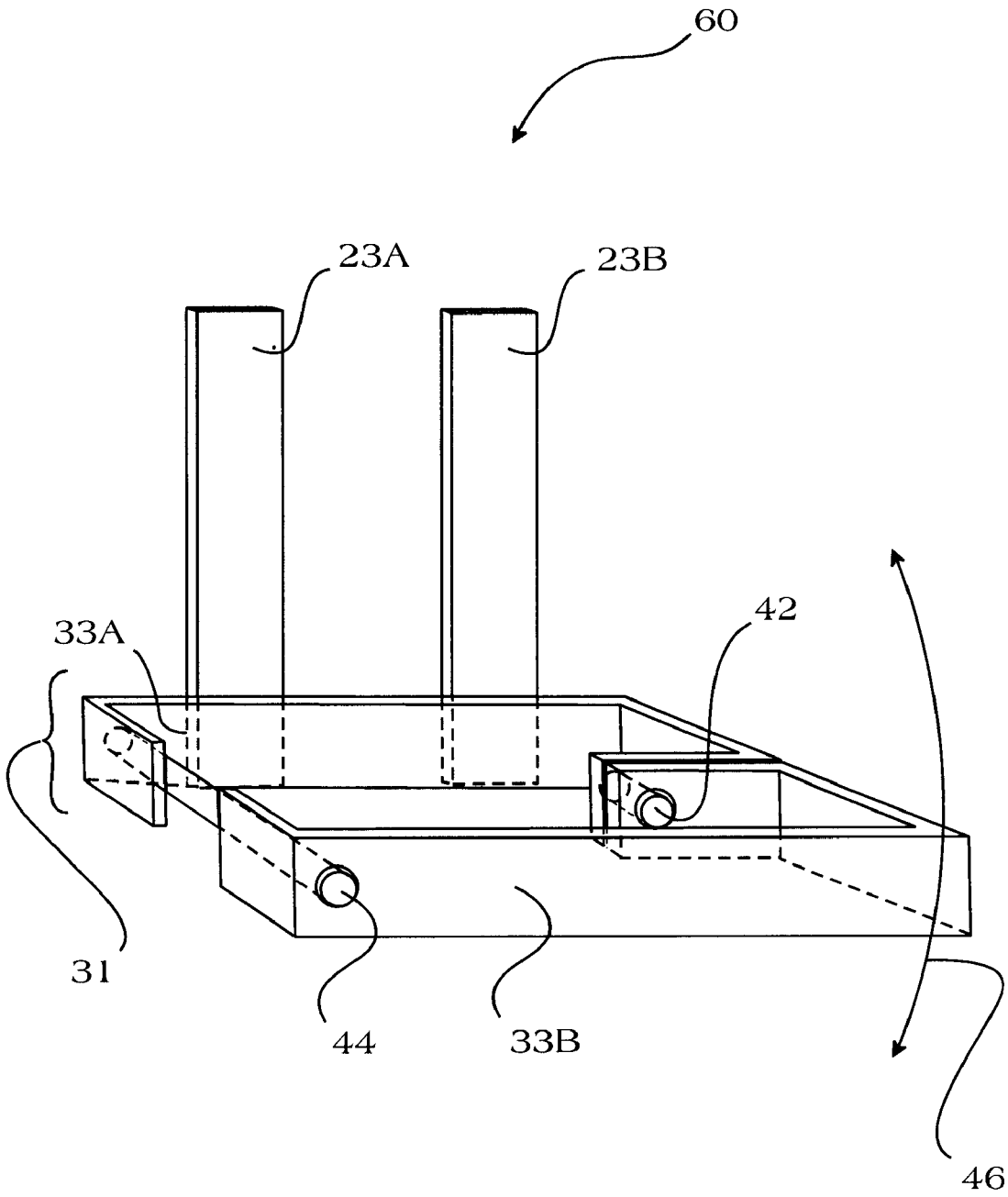
FIG. 6 is a perspective view of an alternate preferred embodiment of a skateboard rack of the present invention.

FIG. 6 is a perspective view of an alternate preferred embodiment of a skateboard rack 60 of the present invention. As we can see here, the rack 60 comprises a pair of struts 23A and 23B through which is attached an alternate wheel lock means 31. The wheel lock means 31 comprises a rear locking ring half 33A and a front locking ring half 33B. The two halves 33 are pivotally attached to one another by a pivot pin 44. This permits the front locking ring half 33B to be rotated up and down along the arc 46 such that a user might place a skateboard within the wheel lock means 31. Once the skateboard has been inserted, a lock bolt or pin 42, such as the one shown above in connection with FIG. 4, can be inserted. If we now turn to FIG. 7, we can see yet another alternate embodiment of a skateboard rack of the present invention.

Figure 7:
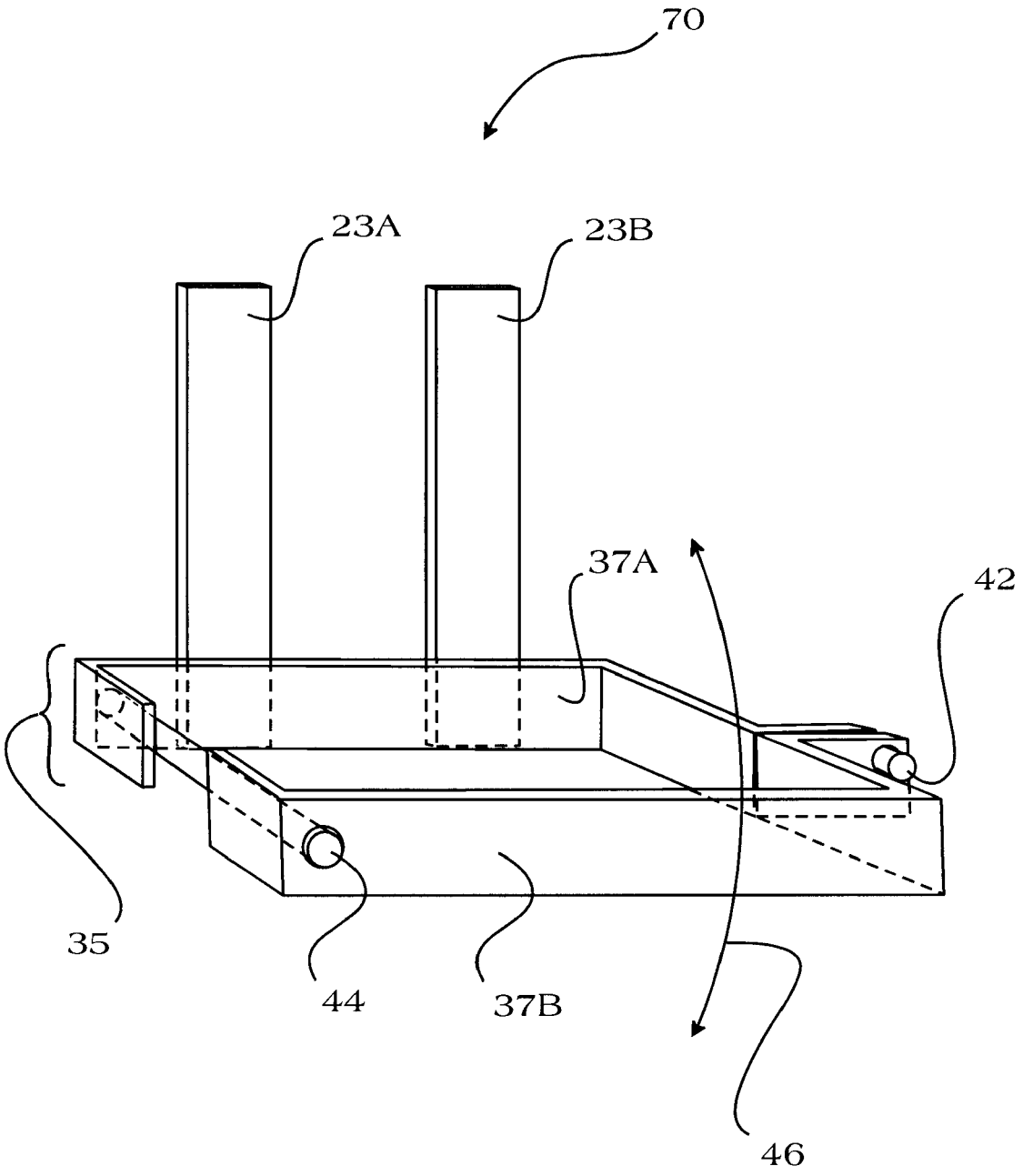
FIG. 7 is a perspective view of another preferred embodiment of a skateboard rack of the present invention.

FIG. 7 is a perspective view of another preferred embodiment of a skateboard rack 70 of the present invention. As in FIG. 6, this rack 70 comprises a pair of struts 23A and 23B and another alternate wheel lock means 35. This wheel lock means 35 comprises an alternate rear locking ring half 37A and an alternate front locking ring half 37B connected to one another by a pivot pin 44. Again, the alternate front locking ring half 37B can travel through an arc of rotation 46 until such time as the lock bolt or pin 42 is inserted within the appropriate apertures provided. Again, this will provide a secure method for locking a skateboard in the rack 70.

Both racks of FIG. 6 and FIG. 7 can be attached to walls or in a manner similar to the rack assembly depicted in FIG. 5.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A skateboard rack, comprising:

a pair of struts;

wheel lock means extending from said struts, configured to accept the wheel assembly of a skateboard; and a locking device for cooperating with said wheel lock means to lock an accepted wheel assembly of a skateboard to said wheel lock means.

2. The rack of claim 1, wherein:

said wheel lock means comprises:

a locking ring extending from said struts, said locking ring further including at least one locking ring aperture formed therethrough for accepting said locking device to lock an accepted wheel assembly of a skateboard.

3. The rack of claim 2, wherein each said strut further comprises:

an elbow;

a bottom end; and at least one strut aperture formed in said strut proximate to said bottom end.

4. The rack of claim 3, wherein:

said locking ring encircles said struts above said elbow, said locking ring further defining a front face, and said locking ring aperture being disposed on said front face; and whereby each said locking ring aperture is alignable with one said strut aperture to form a locking bore.

5. The rack of claim 4, wherein:

said locking device further comprises a lock bolt; and said wheel lock means is locked by inserting said lock bolt through said locking bore and then locking said locking device.

6. The rack of claim 5, further comprising retaining means attached proximate to said struts proximate to said elbows to prevent said unlocked locking ring from being removed from said struts.

7. The rack of claim 2, wherein said locking ring comprises:

a rear locking ring half;

a front locking ring half; and a pivot pin pivotally attaching said front locking ring half to said rear locking ring half.

8. The rack of claim 7, wherein:

said front locking ring half and said rear locking ring half cooperatively define a locked position, said front locking ring half and said rear locking ring half each further include a said locking ring aperture, whereby when said locking ring halves are in said locked position, said locking ring apertures align to form a locking bore;

said locking device further comprises a lock bolt; and said wheel lock means is locked by inserting said lock bolt through said locking bore and then locking said locking device.

9. A skateboard rack assembly, comprising:

a base frame; and at least two skateboard racks extending from said base frame, each said skateboard rack comprising:

at least one strut;

wheel lock means extending from said at least one strut, configured to accept the wheel assembly of a skateboard; and a locking device for cooperating with said wheel lock means to lock an accepted wheel assembly of a skateboard to said wheel lock means.

10. The rack assembly of claim 9, wherein said base frame comprises:

a plurality of horizontal bars; and at least two vertical posts attached to said horizontal bars.

11. The rack assembly of claim 10, wherein said skateboard racks are attached to said horizontal bars in spaced relation to one another.

12. An improved skateboard security device, comprising:

at least one strut;

wheel lock means extending from said at least one strut, configured to accept the wheel assembly of a skateboard, whereby said skateboard might hang from said wheel lock means by said wheel assembly, said wheel lock means comprising a locking ring extending from said at least one strut, said locking ring further including at least one locking ring aperture formed therethrough for accepting said locking device to lock an accepted wheel assembly of a skateboard; and a locking device for cooperating with said wheel lock means to lock said accepted wheel assembly to said wheel lock means.

13. The rack of claim 12, wherein each said strut further comprises:

an elbow;

a bottom end; and at least one strut aperture formed in said strut proximate to said bottom end.

14. The rack of claim 13, wherein:

said locking ring encircles said at least one strut above said elbow, said locking ring further defining a front face, and said locking ring aperture being disposed on said front face; and whereby each said locking ring aperture is alignable with one said strut aperture to form a locking bore.

15. The rack of claim 14, wherein:

said locking device further comprises a lock bolt; and said wheel lock means is locked by inserting said lock bolt through said locking bore and then locking said locking device.

16. The rack of claim 15, further comprising retaining means attached proximate to said struts proximate to said elbows to prevent said unlocked locking ring from being removed from said at least one strut.

17. The rack of claim 12, wherein said locking ring comprises:

a rear locking ring half attached to said at least one strut;

a front locking ring half; and a pivot pin pivotally attaching said front locking ring half to said rear locking ring half.

18. The rack of claim 17, wherein:

said front locking ring half and said rear locking ring half cooperatively define a locked position, said front locking ring half and said rear locking ring half each further include a said locking ring aperture, whereby when said locking ring halves are in said locked position, said locking ring apertures align to form a locking bore;

said locking device further comprises a lock bolt; and said wheel lock means is locked by inserting said lock bolt through said locking bore and then locking said locking device.

* * * * *